US006277026B1

(12) United States Patent
Archer

(10) Patent No.: US 6,277,026 B1
(45) Date of Patent: Aug. 21, 2001

(54) SYSTEM AND METHOD FOR FACILITATING THE PURCHASE AND SALE OF LOTTERY TICKETS ONLINE

(75) Inventor: Michael Archer, Dallas, TX (US)

(73) Assignee: MCI Communications Corporation, Washington, DC (US)

( * ) Notice: Subject to any disclaimer, the term of this patent is extended or adjusted under 35 U.S.C. 154(b) by 0 days.

(21) Appl. No.: 09/085,130

(22) Filed: May 27, 1998

(51) Int. Cl.[7] ..... A63F 9/24
(52) U.S. Cl. ..... 463/42; 463/17
(58) Field of Search ..... 463/16, 17, 18, 463/19, 25, 29, 40, 41, 42

(56) References Cited

U.S. PATENT DOCUMENTS

| | | | | |
|---|---|---|---|---|
| 5,505,449 | * | 4/1996 | Eberhardt et al. | 273/138 A |
| 5,772,511 | * | 6/1998 | Smeltzer | 463/17 |
| 5,935,000 | * | 8/1999 | Sanchez, III et al. | 463/17 |
| 6,012,984 | * | 1/2000 | Roseman | 463/42 |
| 6,024,641 | * | 2/2000 | Sarno | 463/17 |

OTHER PUBLICATIONS

"Maryland Lottery Games at the Wine Rack" retrieved via the Internet and World–Wide–Web at http://www.wdn.com/ems/rack/lottery/lottery.htm, Feb. 23, 1998, 11:01 am.

"Product Overview" retrieved via the Internet and World–Wide–Web at http://www.mci2000.com, Jun. 27, 1997, 2:10:50pm.

"Get Your Digital ID Now" retrieved via the Internet and World–Wide–Web at the VeriSign Web Site (www.verisign-.com), Jun. 30, 1997, 3:15:00pm.

"Digital ID Services for Individuals" retrieved via the Internet and World–Wide–Web at the VeriSign web site (www.verisign.com), Jun. 30, 1997, 3:15:24pm.

"Class 1 Secondary Certificate Upgrade" retrieved via the Internet and World–Wide–Web at the VeriSign Web Site (www.verisign.com) Jun. 30, 1997, 3:16:00pm.

"Economic Success of Internet Unproven–Novell Exec" retrieved via the Internet and World–Wide–Web at the Yahoo (www.yahoo.com) Jun. 30, 1997, 9:00:28am.

* cited by examiner

*Primary Examiner*—Valencia Martin-Wallace
*Assistant Examiner*—Julie Kasick

(57) ABSTRACT

A system and method for facilitating the sale of a lottery ticket online includes and involves a data storage system and a data processing system. The data storage system is used for storing information related to a lottery ticket purchased online and to a purchaser of the lottery ticket. The lottery ticket includes a lottery game value. The data processing system is coupled to the data storage system and is operative to receive an online request from the purchaser to purchase the lottery ticket, to generate a secure lottery ticket purchase code, and to issue a purchase confirmation notice related to the lottery ticket to the purchaser. The purchase confirmation notice includes the secure lottery ticket purchase code. The data processing system is further operative to store the information and the lottery ticket purchase code in the data storage system.

26 Claims, 12 Drawing Sheets

SYSTEM AND METHOD FOR FACILITATING THE PURCHASE AND SALE OF LOTTERY TICKETS ONLINE

BACKGROUND OF THE INVENTION

1. Field of the Invention

The present invention relates to systems and methods that are used to sell lottery tickets.

2. Description of the Related Art

Since its creation, the Internet has been considered to be a viable and effective system for distribution of information to large numbers of people. Despite its wide acceptance as an information distribution system, however, Internet service providers have faced significant challenges in terms of establishing sites and corresponding services that can enhance the features of the Internet and which can be used to generate revenue. In many respects, the challenges facing Internet service providers (ISPs) result from difficulties in establishing and operating successful sites that can reliably generate revenue related to repeat business. As such, since most information on the Internet is distributed for free, it has become difficult to establish Internet sites (e.g., web sites) that attempt to charge online customers for information and other services.

As ISPs and other service providers wrestle with creating and establishing sites that can reliably generate revenue from repeat sales network users have become increasingly reliant on the "free" nature of the Internet. To establish revenue generating sites, ISPs have established a wide range of online service offerings ranging from the sale of travel related services (e.g., airline tickets) to subscriptions for network content channels that deliver otherwise unavailable information. In most cases, however, such service offerings are restricted by fierce competition and availability of similar, free information from other network sites.

A service area that has not been tapped by ISPs is the sale and distribution of lottery tickets on behalf of state-run lottery commissions. Currently, there exists no system for the sale and distribution of lottery tickets online. It is well known that lottery ticket sales generate large sums of money for state-run programs. And, it is well-known that sales of lottery tickets create significant commission revenue for authorized lottery ticket selling agents. Such sales result from repeat customers who regularly purchase tickets. Unfortunate for ISPs, is the fact that many of the lottery tickets sold by lottery ticket sales agents are bearer instruments—the bearer of a winning ticket is entitled to receive payment if his ticket contains a winning number or code relative to a particular lottery game or drawing. The Internet does not lend itself to sale and distribution of instruments (official or otherwise) like bearer instruments because there are no ways to ensure that a document printed by a person's printer, for example, is authentic. Accordingly, ISPs have heretofore been unable to establish themselves as lottery ticket sales agents because they have been unable to effectively deal with the nature of lotteries and the conventional, bearer nature of lottery tickets. As such, ISPs have heretofore not been able to establish Internet sites (e.g., web sites) which can be accessed by network users on a regular basis to purchase lottery tickets and which can be used to reliably generate revenue from repeat business and lottery ticket sales commissions.

Thus, there exists a need to provide systems and methods for facilitating the purchase and sale of lottery tickets online. To be viable, such systems and methods must facilitate the sale of lottery tickets without distributing bearer-type tickets and like.

SUMMARY OF THE INVENTION

The present invention addresses the limitations and problems associated with the related art by providing systems and methods that facilitate the sale of lottery tickets to network users (purchasers) without distributing bearer-type instruments. The systems and methods of the present invention enable lottery ticket sales through generation and recordation of secure lottery ticket purchase codes which may be used to verify the sale of a winning lottery ticket entry. As such, lottery service providers (ISPs authorized to sell lottery ticket entries) may establish and operate Internet (e.g., web) sites that encourage widespread use and repeat sales.

Accordingly, the present invention provides a system and method for facilitating the purchase and sale of a lottery ticket online that includes a data storage system and a data processing system. The data storage system is used for storing information related to a lottery ticket purchased online and to a purchaser of the lottery ticket. The lottery ticket includes a lottery game value. The data processing system is coupled to the data storage system and is operative to receive an online request from the purchaser to purchase the lottery ticket, to generate a secure lottery ticket purchase code, and to issue a purchase confirmation notice related to the lottery ticket to the purchaser. The purchase confirmation notice includes the secure lottery ticket purchase code. The data processing system is further operative to store the information and the lottery ticket purchase code in the data storage system.

According to another aspect of the present invention, a method for facilitating the purchase and sale of a lottery ticket online is provided. The method includes a step of receiving an online request from a purchaser to purchase a lottery ticket in the context of a lottery operated by a lottery authority or lottery commission. The online request includes information related to the purchaser and to a lottery game value to be associated with the lottery ticket. The method also includes the steps of generating a secure lottery ticket purchase code and issuing a purchase confirmation notice related to the lottery ticket to the purchaser. The purchase confirmation notice includes the secure lottery ticket purchase code. The method also includes a step of retrievably storing the information, the lottery game value, and the secure lottery ticket purchase code in a data storage system to be accessed by the lottery authority in operating the lottery.

According to another aspect of the present invention, a system for facilitating a lottery payoff based on a lottery ticket purchased online is provided. The system includes a lottery ticket issuance system that stores information related to a lottery ticket purchased online, a secure lottery ticket purchase code, and a purchaser of the lottery ticket. The lottery ticket has an associated lottery game payoff amount. The system also includes a lottery management system that is operated by a lottery authority and which is coupled to the lottery ticket issuance system. The lottery management system is operative to receive a request from the purchaser to receive the payoff amount associated with the lottery ticket. The request includes a request code. The management system also is operative to access and query the lottery ticket issuance system to determine if the request code matches the secure lottery ticket purchase code, and to receive a match status message from the lottery ticket issuance system which will indicate whether the request code matches the secure lottery ticket purchase code. Also, the management system is operative to notify the lottery authority that the payoff amount may be paid to the purchaser when the request code matches the secure lottery ticket purchase code.

According to another aspect of the present invention, a method for facilitating a lottery payoff based on a lottery ticket purchased online is provided. The method includes the steps of receiving a request from a purchaser to receive a payoff amount associated with a lottery ticket purchased online. The request includes a request code. The method also includes the steps of accessing and querying a lottery ticket issuance system to determine if the request code matches a previously stored secure lottery ticket purchase code, and receiving a match status message from the lottery ticket issuance system. The match status message indicates whether the request code matches the previously stored secure lottery ticket purchase code. The method also includes a step of notifying a lottery authority that the payoff amount may be paid to the purchaser when the request code matches the previously stored secure lottery ticket purchase code.

BRIEF DESCRIPTION OF THE DRAWINGS

The present invention is described in detail below with reference to the following drawing figures of which.

DETAILED DESCRIPTION OF THE PREFERRED EMBODIMENTS

Figure 1:
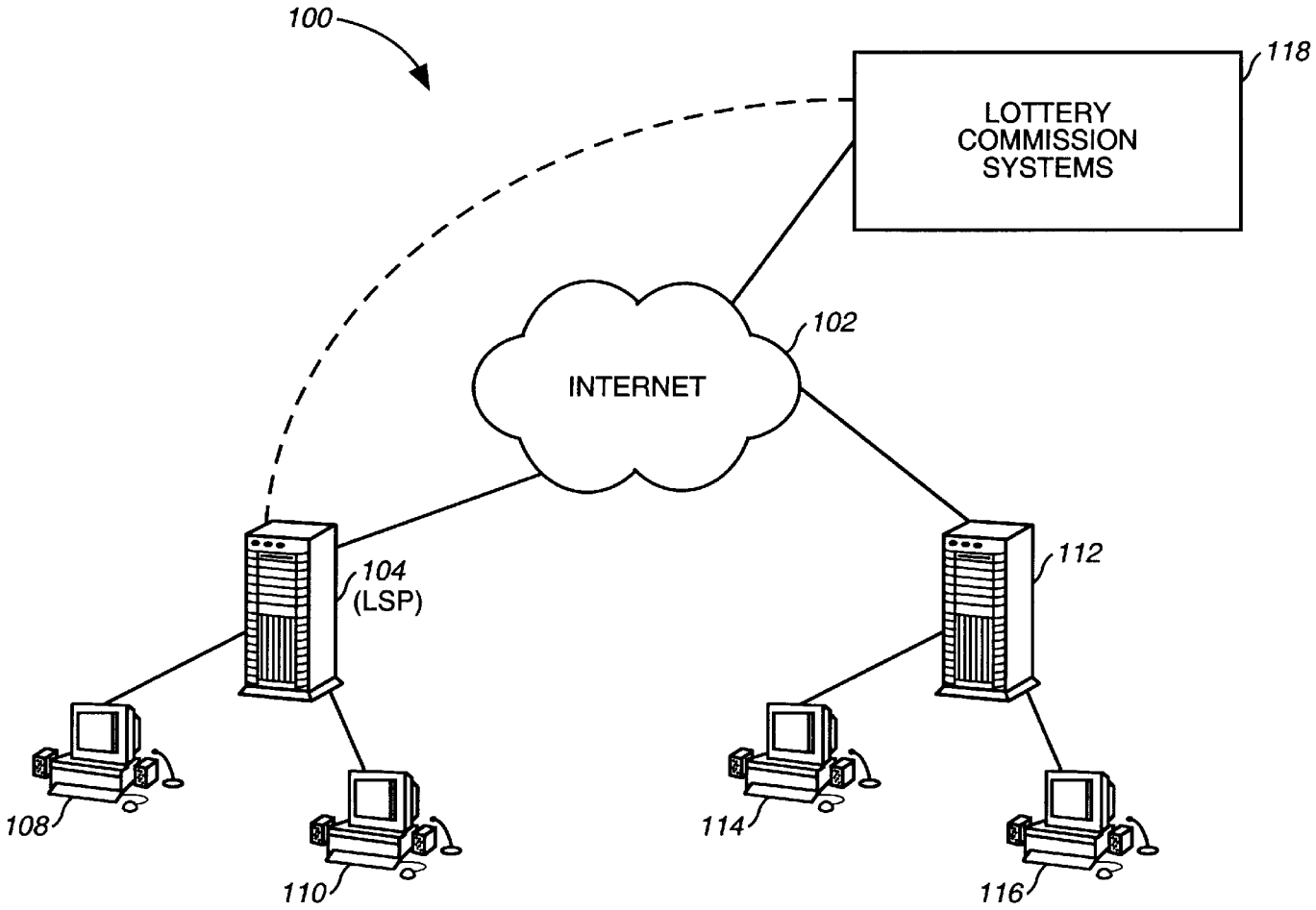
FIG. 1 is a diagram of a system in which lottery tickets may be sold to users online (e.g., via the Internet) according to a preferred embodiment of the present invention.

The present invention is now discussed in detail with regard to the drawing figures that were briefly described above. A definitions section is followed by a discussion of the structural and operational aspects of the present invention. Unless otherwise indicated, like parts and processes are referred to with like reference numerals.

DEFINITIONS

The following terms shall have the following meanings in the context of the present invention.

The term "lottery" means any legally authorized drawing game of chance that involves the purchase and sale of game entries. Each game entry or "entry" includes an entry value such as a number, code, pattern, or string of characters (alpha, numeric, symbol, or otherwise) that may be selected or picked (or unveiled such as by "scratching off") by a purchaser of such an entry or which may be generated automatically (e.g., randomly generated numbers, etc.). Exemplary lotteries include the Texas State Pick-3 lottery and the Maryland State Pick-4 lotteries. In both examples, an entry in the lotteries will include a number which a purchaser picks or which is automatically generated and for which the purchaser pays an entry fee to place a bet that the picked number will be drawn during a drawing to be held on a specific date and at a specific time. If the purchaser's number or entry is drawn, he may visit an authorized payoff agent (authorized payment center) and receive payment relative to his lottery entry based on pre-determined odds.

The term "lottery ticket" means a confirmation notice that is submitted to a network user or purchaser of an entry into a lottery drawing managed by a lottery commission (e.g., a state-run lottery commission or authority) in conjunction with a secure lottery ticket purchase code that may be created, stored, and maintained by a lottery ticket selling agent such as an Internet service provider (ISP) that is authorized by a lottery commission to sell lottery tickets online. Accordingly, while the present invention contemplates the sale of lottery tickets which may be distributed to a purchaser's computer system and printed out thereby on a personal printing device (e.g., a laser printer, an ink-jet printer, etc.) and which may be considered as bearer instruments like conventional store-bought lottery tickets, the present invention requires no physical lottery ticket like conventional paper-form bearer instruments. Accordingly, a lottery ticket according to the present invention includes one that is maintained as a record within a data processing system (e.g., by a lottery service provider—an ISP authorized to sell lottery entries) and which may be claimed by a purchaser of the same who presents proof of ownership (e.g., printouts of confirmation screens, driver's licenses, passwords and other secure identification (PIN) codes, etc.) along with a secure lottery ticket purchase code to a lottery payoff agent or to an authorized payment center.

STRUCTURAL ASPECTS OF THE PRESENT INVENTION

In view of the aforementioned definitions related to the present invention, reference is now made to the drawing figures briefly described above.

Referring now to FIG. 1, depicted therein is a diagram of a system in which lottery tickets may be sold to users online according to a preferred embodiment of the present invention. In particular, system 100 includes a network such as the Internet 102, an ISP 104 which has been authorized by a lottery commission (e.g., a state-run lottery commission or authority) to act as a lottery service provider (LSP), an ISP 112, lottery commission systems 118 which may be operated by a state-run lottery commission, and an exemplary user population further including users 108, 110, 114, and 116.

LSP 104 includes data processing systems to allow data communications via the HTTP (hyper-text transfer protocol) via the world wide web (WWW) on the Internet. Accordingly, LSP 104 preferably maintains a web site which may be accessed via the Internet or directly. That is, users like users 108 and 110 may receive their Internet service links directly with the ISP that also acts as LSP 104. Alternatively, users like users 114 and 116 may receive their internet service links from non-LSP ISPs like ISP 112 and are therefore required to navigate to LSP 104 via the Internet 102 to purchase lottery tickets. A detailed description of the components of LSP 104 is found below with regard to FIG. 2.

Users 108, 110, 114, and 116 are equipped with personal data processing systems such as multi-media personal computers that allow Internet and web-based communications. A detailed description of the components of a typical personal data processing system that may be used to facilitate the purchase of a lottery ticket online is found below with regard to FIG. 3.

The entities and systems included within system 100 are coupled together in conventional ways which will be immediately understood by those skilled in the art. For example, a user such as user 108 may be coupled to LSP 104 via conventional telephone lines. Additionally, LSP 104 likely will be coupled to the Internet 102 via high-speed telecommunications lines.

In system 100, because of the agency relationship of LSP 104 and a particular lottery commission or authority, LSP 104 must be coupled to lottery commission systems 118. LSP 104 may be coupled to lottery commission systems 118 via the Internet 102 and/or via dedicated telecommunications lines as indicated by the dashed line between LSP 104 and lottery commission systems 118. In any case, the coupling of LSP 104 to lottery commission systems 118 to allow for secure data communications will be readily understood by those skilled in the art.

In system 100, LSP 104 may be considered as a lottery ticket issuance system and lottery commission systems 118 may be considered as lottery management systems which are operated by a lottery commission or authority. Accordingly, an entity that operates LSP 104 may collect sales commissions from the online sale of lottery tickets, much like conventional stores receive commissions for the sales of paper-based lottery tickets.

It should be understood that although FIG. 1 illustrates an exemplary arrangement and number of components, the present invention is not so restricted. For example, many more systems and users may be included within a particular system that facilitates the purchase and sale of lottery tickets online such as via the Internet.

Figure 2:
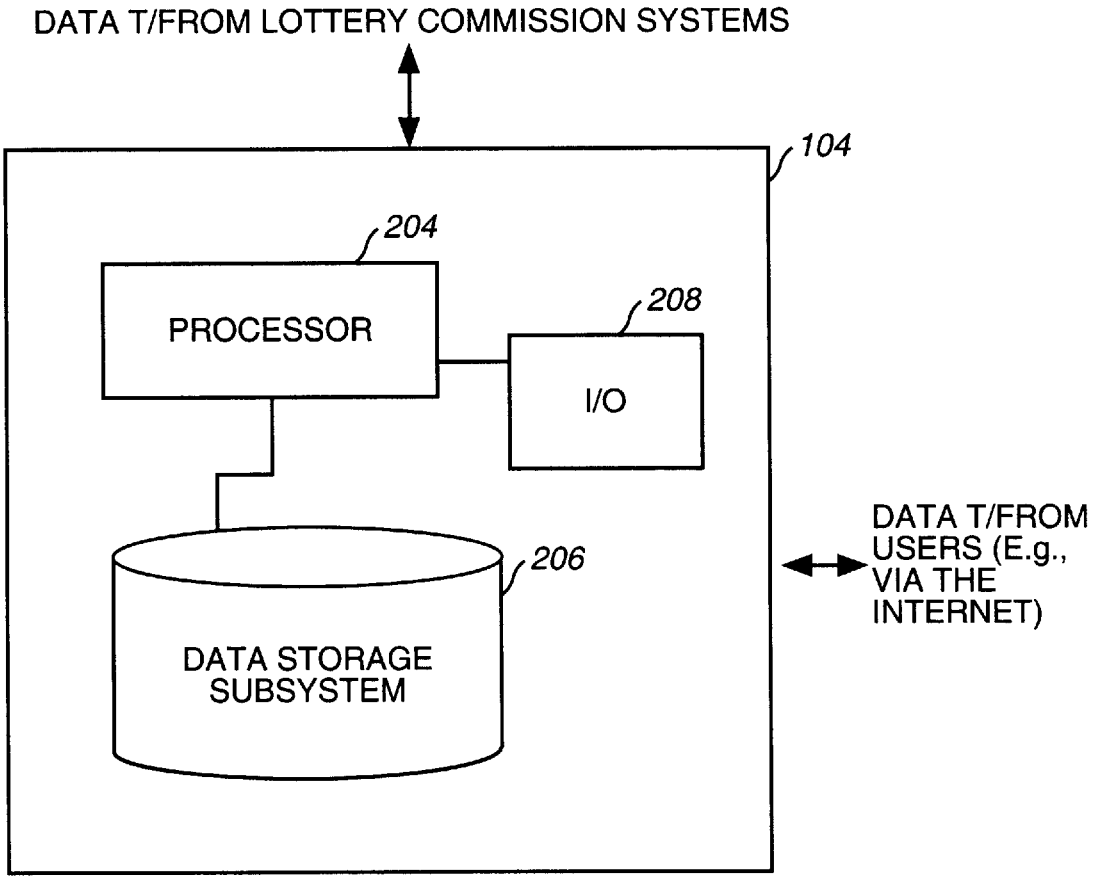
FIG. 2 is a block diagram of the lottery service provider's data processing system as originally depicted in FIG. 1.

Referring now to FIG. 2, depicted therein is a block diagram of the lottery service provider's data processing system as shown in FIG. 1. In particular, LSP 104 includes an automatic data processing system that is configured to support data communications between users such as via the Internet 102 and data communications between lottery commission systems 118 such as via the Internet or through other input/output facilities over dedicated communications links. As such, LSP 104 includes one or more processors 204, a data storage subsystem 206 (e.g., one including disk storage, etc.), and input/output (I/O) facilities 208 to enable data communications as previously described.

A suitable data processing system that may be used to implement LSP 104 is a SUN SPARC SYSTEM (e.g., SPARC 1000) that is configured to run the SUN SOLARIS operating system which are manufactured and marketed by SUN MICROSYSTEMS, INC. Other systems of similar or like functionality may be used.

LSP 104 is configured via software control, for example, to act as a web server that has application capabilities to facilitate the purchase and sale of lottery tickets online. Web server functionality may be instantiated through use of appropriate web server software packages like those manufactured and marketed by MICROSOFT CORPORATION and NETSCAPE CORPORATION. Since LSP 104 will provide the ability to take and process payments relative to lottery ticket sales, LSP 104 may be outfitted with appropriate electronic commerce server software which may provide secure commerce capabilities (e.g., secure credit card transactions, secure debit card transactions, electronic check transactions, etc.). Such electronic commerce server software may include software packages which are manufactured and marketed by MICROSOFT CORPORATION and NETSCAPE CORPORATION.

Figure 6:
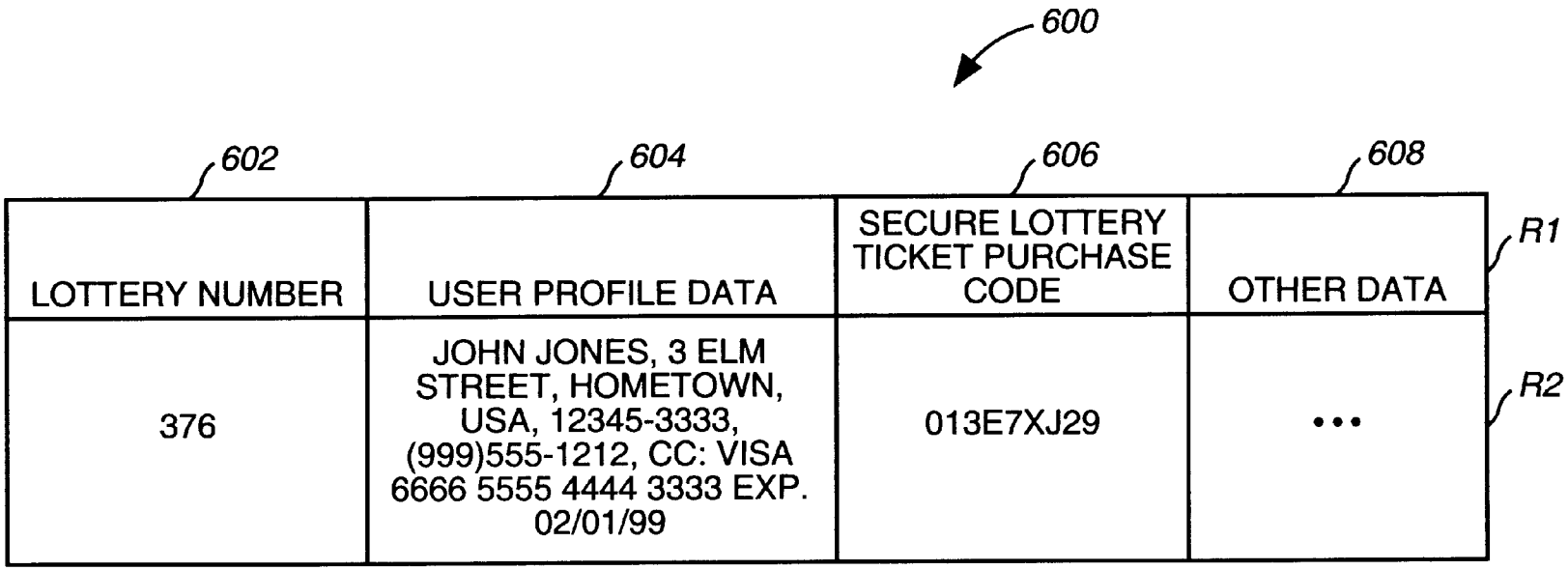
FIG. 6 is a diagram of a database table used for storing information related to a lottery ticket purchased online which may be propagated with data and processed in accordance with the steps illustrated in flowcharts depicted in FIGS. 4A–4E and 5A–5C.

In addition to the lottery ticket sales capabilities of LSP 104 to facilitate lottery ticket purchases online, LSP 104 should be outfitted with appropriate database management software programs and applications to facilitate the tracking of lottery ticket purchases including the recordation and storage of names and addresses of purchases (network users who purchase lottery tickets online), payment information, lottery ticket entry information (e.g., a PICK-3 number, etc.), and a secure lottery ticket purchase code that LSP 104 is configured to generate and maintain relative to a particular online lottery ticket purchase. A suitable database management system that may be used is the ORACLE V.7.0 database management package that is manufactured and marketed by ORACLE CORPORATION. A table structure that may used to store the aforementioned or similar information is shown in FIG. 6 which is discussed below.

In addition to the lottery ticket sales capabilities and database management capabilities of LSP 104, LSP 104 is configured with computer software routines to provide online forms to users via the Internet 102 such as those which are supported by CGI scripts to facilitate online entry of user responses (e.g., lottery ticket numbers, user names, credit card numbers, etc.). Additionally, LSP 104 is configured with software routines and programs to enable the creation of secure lottery ticket purchase codes (e.g., random strings of numbers and letters which may serve as confirmation codes) and random numbers that are generated in formats that may be used as lottery ticket entry values (e.g., drawing values like a specific Pick-3 number or game value), etc. Such functionality is further described with regard to the flowcharts shown in FIGS. 4A–4E which will be immediately understood by those skilled in the art of computer programming after review of the present invention as described herein.

The communications carried between LSP 104 and a user's personal computer system to facilitate the sale and purchase of a lottery ticket online may be carried out using secure socket layer (SSL) technology. SSL technology will be readily understood by those skilled in the art of networking and open standards technologies and protocols.

Figure 3:
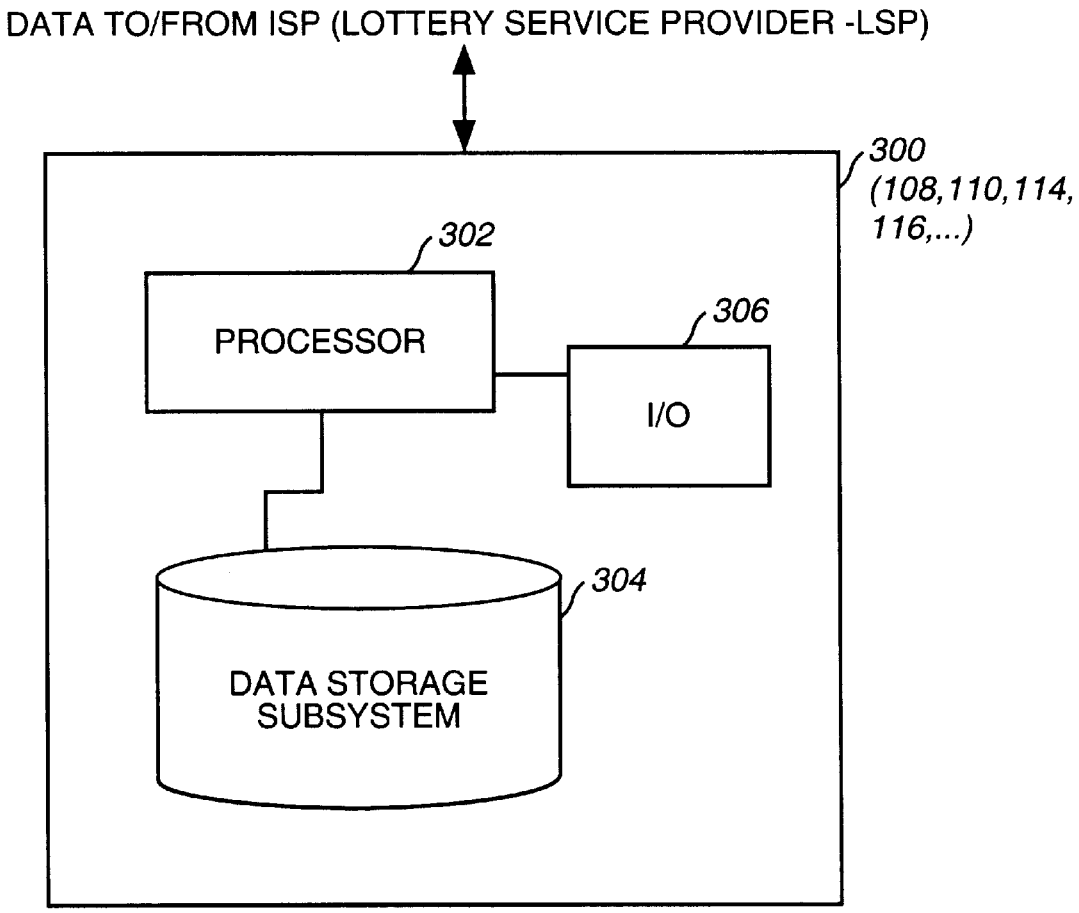
FIG. 3 is a block diagram of a user's personal data processing system like those shown in FIG. 1.

Referring now to FIG. 3, depicted therein is a block diagram of a user's personal data processing system like those shown in FIG. 1. In particular, personal data processing system 300 may be operated by a user such as users 108, 110, 114, and 116 to facilitate an online purchase of a lottery ticket according to the present invention. System 300 includes a processor 302, a data storage subsystem 304, and an I/O facility 306. System 300 is configured to facilitate data communications between an ISP like LSP 104 (FIG. 1).

A suitable personal data processing system that may be used to implement system 300 is a personal computer system manufactured and marketed by COMPAQ COM- PUTER CORPORATION. Such a system may be operated in accordance with the WINDOWS 95 operating system which is manufactured and marketed by MICROSOFT CORPORATION.

System 300 is configured to be coupled to the Internet 102 via a phone line (such as by way of a modem device—not shown), a network connection (such as by way of a network interface device—not shown), a cable modem device (not shown) or via some other form of network coupling arrangement. Once coupled to the Internet 102 via an ISP such as LSP 104, system 300 will be able to support Internet and web based communications through use of a web-browser software package which supports HTTP communications and related functionality (e.g., forms, etc.). A suitable web-browser software package that may be used to facilitate network communications is the NETSCAPE COMMUNICATOR BROWSER SUITE (V.4.0) which is manufactured and marketed by NETSCAPE COMMUNICATIONS CORPORATION.

To facilitate secure network communications within system 300 and an appropriate browser software package, a secure certificate will likely have to be obtained from a digital certificate supplier. Such secure certificates will allow a user of system 300 to engage in secure, encrypted network communications which are necessary to provide secure electronic commerce, etc., and which are used within the present invention to facilitate the purchase and sale of lottery tickets online. A suitable secure digital certificate that may be used within the present invention is one created and distributed by VERISIGN at www.verisign.com on the Internet or one of other similar or like functionality.

OPERATIONAL ASPECTS OF THE PRESENT INVENTION

The structures depicted in FIGS. 1–3 are configured to operate together to facilitate the purchase and sale of lottery tickets online according to the present invention. The requisite and salient operations to bring about such functionality and services are illustrated in FIGS. 4A–4E. More particularly, the operations depicted in FIGS. 4A–4E, in many respects, are intended to be carried out, as indicated above, via computer software. Such computer software and, in particular, the programming constructs necessary to bring about such operations will be readily apparent to those skilled in the art after reviewing and understanding the operations illustrated in FIGS. 4A–4E.

Figure 4A:
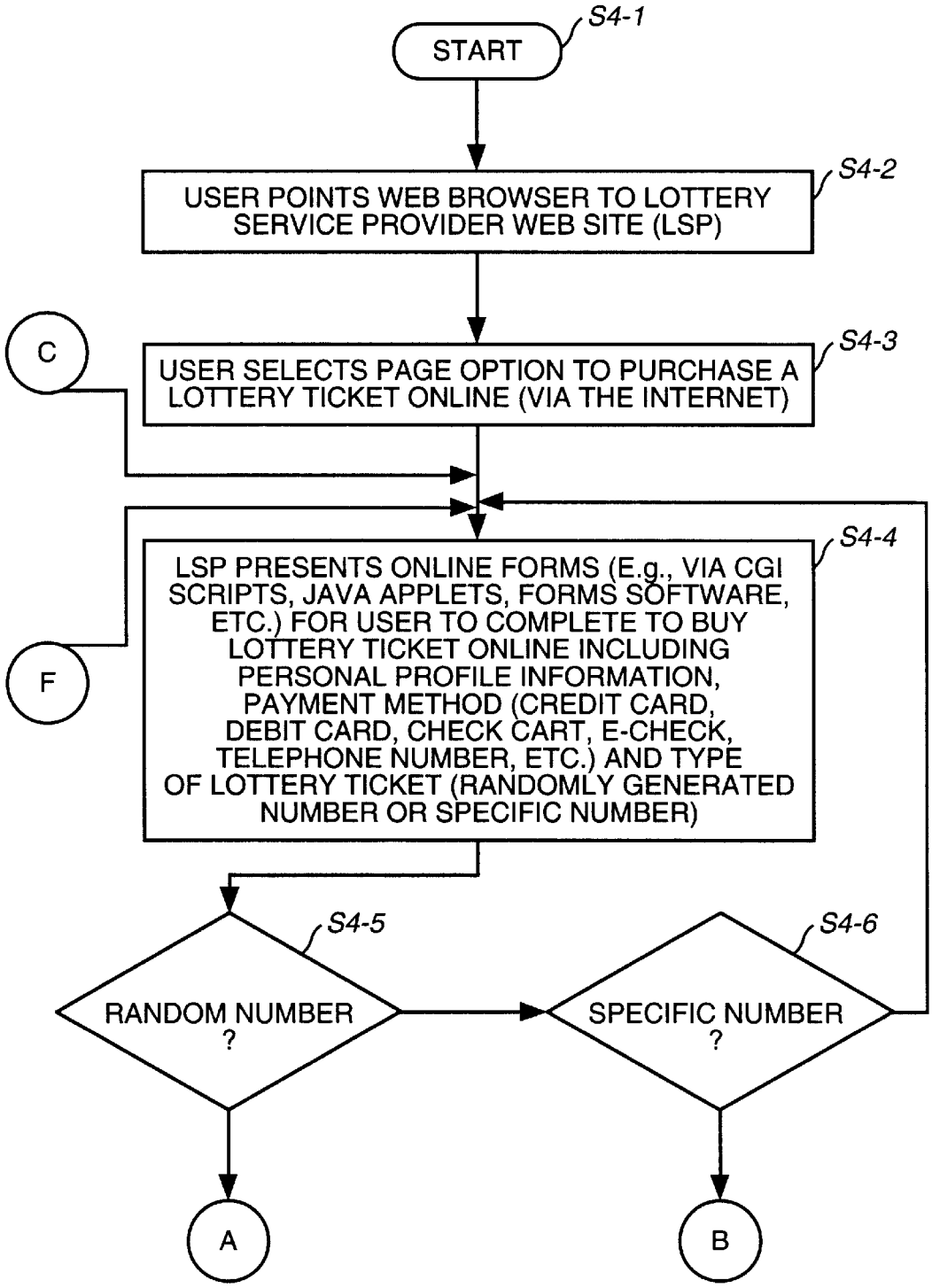
FIG. 4A is a flowchart that illustrates a process carried out within the system depicted in FIG. 1 to facilitate the purchase and sale of lottery tickets online according to a preferred embodiment of the present invention.

Referring now to FIG. 4A, depicted therein is a flowchart that illustrates a process carried out within the system depicted in FIG. 1 to facilitate the purchase and sale of lottery tickets online according to a preferred embodiment of the present invention. Processing starts at Step S4-1 and immediately proceeds to Step S4-2.

At Step S4-2, a user will point his browser software to a LSP 104 managed web site to purchase a lottery ticket online. Thereafter, at Step S4-3, the user will select a page or option indicating his desire to purchase a lottery ticket online.

Next, at Step S4-4, LSP 104 will present and transmit a form for the user to complete to purchase a lottery ticket online. The form may ask for user profile information (e.g., name, address, telephone number, etc.), payment method (e.g., credit card, etc.) and number, a lottery ticket entry value (e.g., a PICK-3 number, a PICK-4 number, or an option to have a randomly generated number assigned, etc.). Such form delivery and the processing of the same (e.g., via CGI scripts Java, forms software clients, etc.) will be readily understood by those skilled in the art. It should be noted that at secure web data communications may be established at Step S4-4 through use of SSL and/or other security processes such as through use of a digital certificate maintained by the user. Such secure data communications may be used to facilitate secure electronic commerce related to credit card transactions, etc., which will be readily understood by those skilled in the art.

Figure 4B:
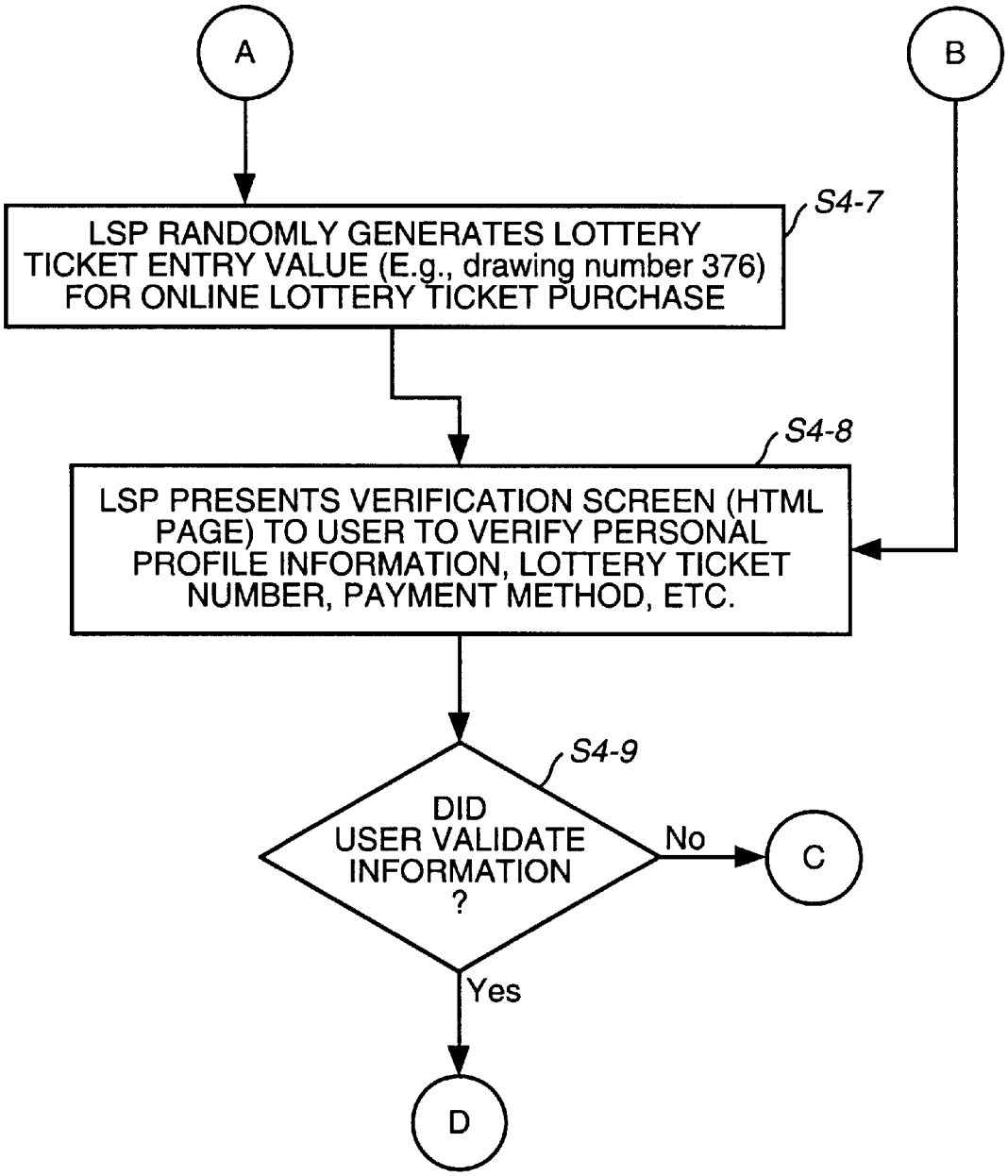
FIG. 4B is a continuation flowchart of the flowchart started in FIG. 4A.

Next, at Step S4-5, LSP 104 will determine from completed form data from the user received, for example, via the Internet 102, whether the user desires to have a randomly generated lottery ticket value assigned to his lottery ticket purchase. If a random lottery number is desired, processing proceeds as illustrated at the top of FIG. 4B. If not, processing proceeds to Step S4-6.

At Step S4-6, LSP 104 will determine from the user's entered form data, if the user desires to purchase a lottery ticket for a specific number (e.g., a specific PICK-3 number like "376"). If a specific number is desired, processing proceeds as illustrated at the top of FIG. 4B. If not processing returns to Step S4-4 or until the user terminates the purchase of a lottery ticket online (e.g., via closing his lottery ticket purchase web session, etc.).

At the top of FIG. 4B, a type of lottery ticket purchase has been selected. That is, LSP 104 will know whether the user intends to purchase a randomly generated lottery number or a specific number. If a randomly generated number was desired, processing proceeds to Step S4-7. At Step S4-7, routines within LSP 104 (e.g., application routines to generate random numbers, etc.), will generate a lottery ticket entry number for the user's lottery ticket purchase and processing will proceed to Step S4-8. If a specific number is desired by the user, processing immediately proceeds to Step S4-8. It should be understood that the present invention contemplates local generation of lottery numbers (e.g., by an LSP) and remote generation of lottery numbers (e.g., as in the case of one LSP querying another LSP for number generation, etc.)

At Step S4-8, LSP 104 will present a verification web form to the user for him to verify personal data (e.g., name and address, payment data, lottery ticket entry value, etc.).

Figure 4C:
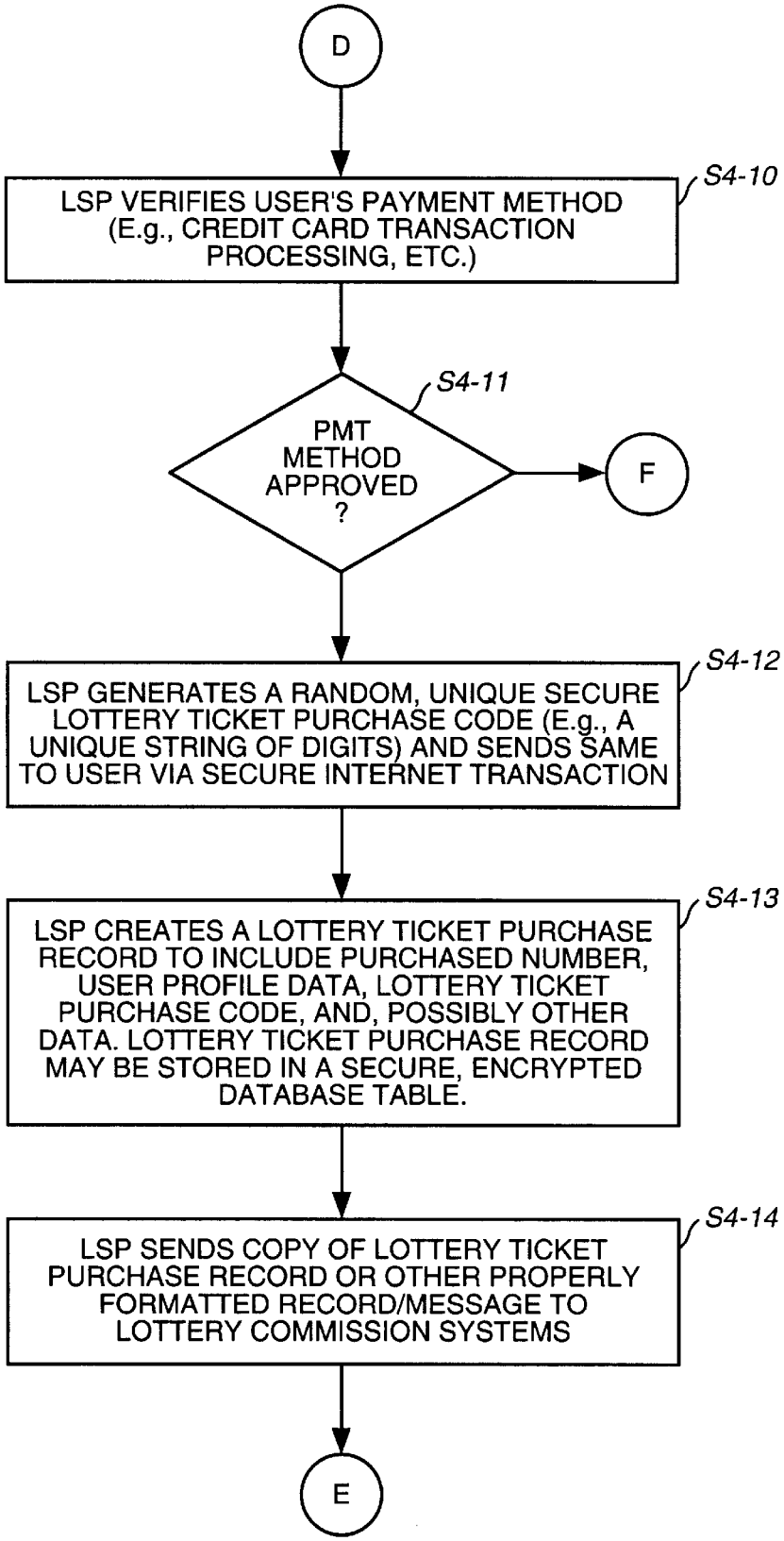
FIG. 4C is a continuation flowchart of the flowchart depicted in FIGS. 4A–4B.

Next, at Step S4-9, a determination will be made as to whether the user validated the lottery ticket purchase information. If the user validated his lottery ticket purchase information, processing proceeds as illustrated at the top of FIG. 4C. If not, processing proceeds as illustrated in FIG. 4A (as earlier described).

At Step S4-10 (at the top of FIG. 4C), LSP 104 will verify user's payment method (e.g., engage in credit card, debit card, or other corresponding processing). Next, a determination will be made at Step S4-11 as to whether the user's payment method was approved. If not processing proceeds as illustrated in FIG. 4A (as discussed above). If approved, processing proceeds to Step S4-12.

At Step S4-12, LSP 104 will generate a secure lottery ticket purchase code such as a random, unique security string of digits, etc. LSP 104 will supply the same to the user via the Internet 102 through use of a secure Internet transaction (e.g., via use of SSL, etc.).

Next, at Step S4-13, LSP 104 will create a lottery ticket record including a purchased lottery number, user profile data, and the aforementioned random, unique secure lottery ticket purchase code. The lottery ticket purchase record will be stored in a secure encrypted data base which may be maintained and managed by appropriate database management system software operated by LSP 104. An illustration of such an encrypted database table is found in FIG. 6 which is discussed below.

Figure 4D:
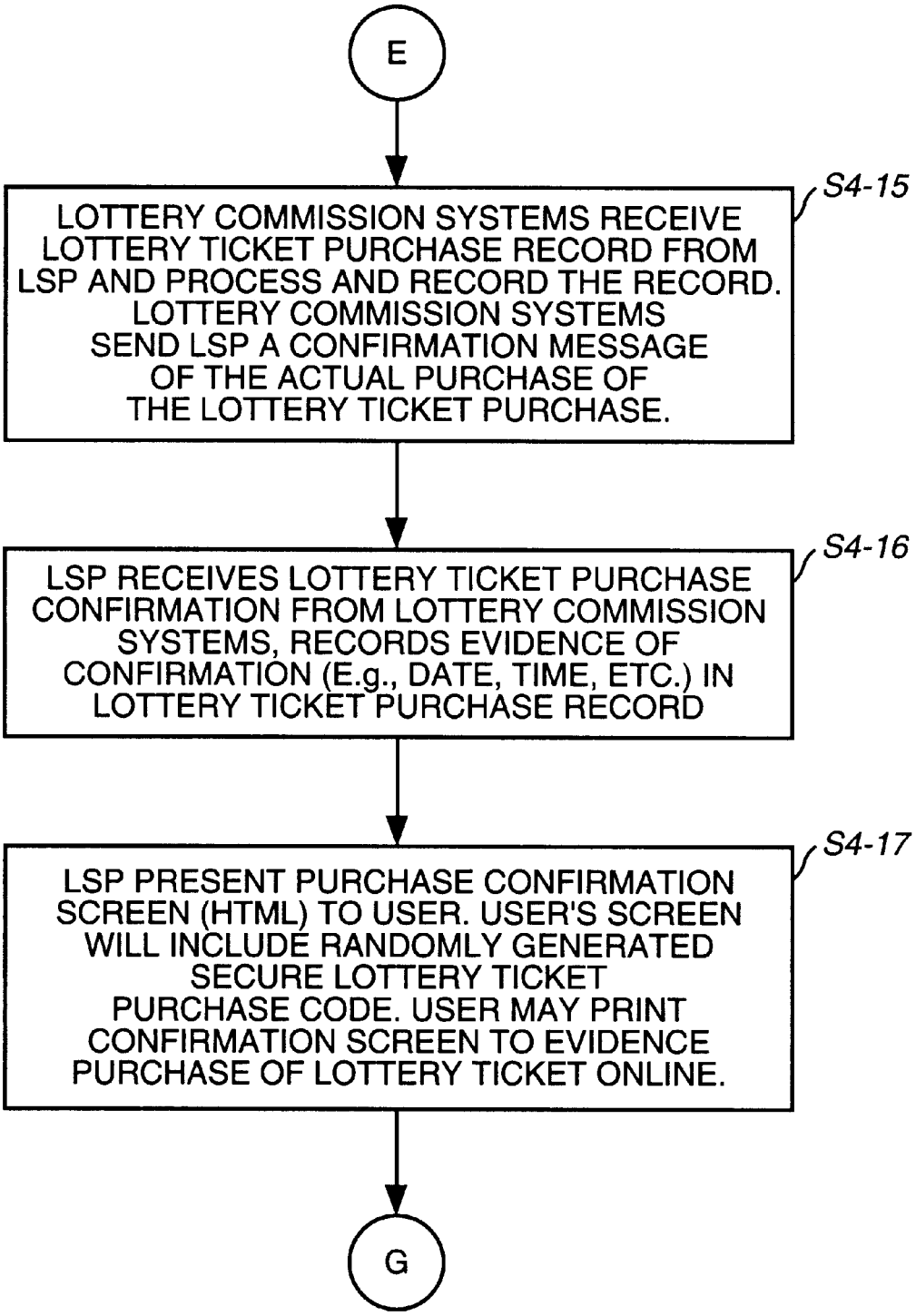
FIG. 4D is a continuation flowchart of the flowchart depicted in FIGS. 4A–4C.
Figure 4E:
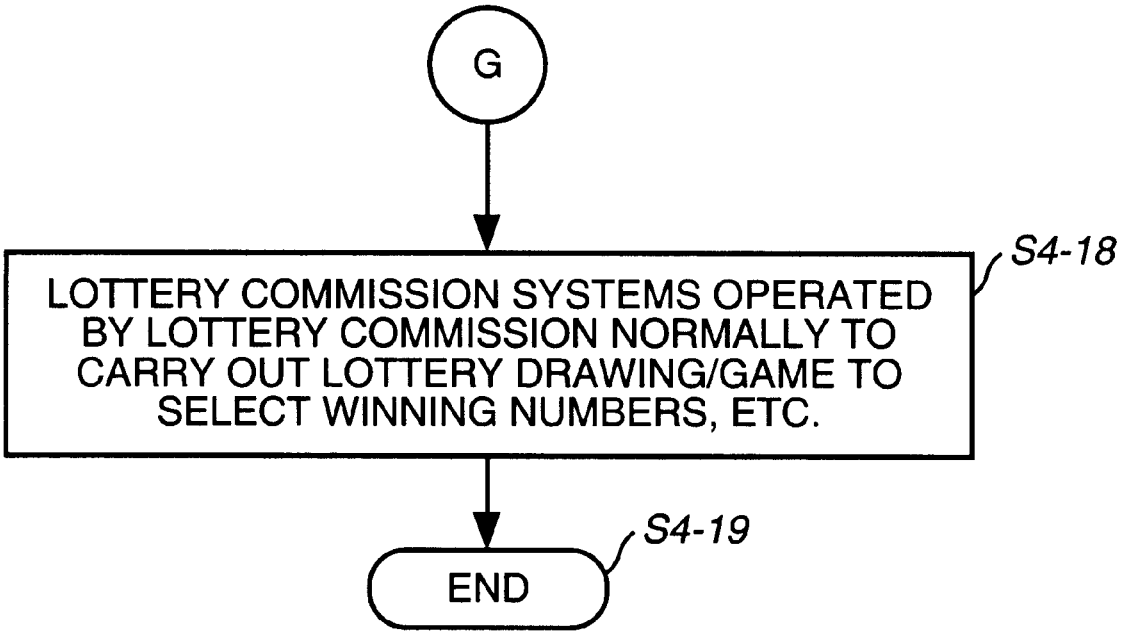
FIG. 4E is a continuation flowchart of the flowchart depicted in FIGS. 4A–4D.

Thereafter, at Step S4-14, LSP 104 will send a copy of the lottery ticket purchase record or other properly formatted data structure/message to lottery commission systems 118. And, processing will proceed as illustrated at the top of FIG. 4D.

At Step S4-15 (at the top of FIG. 4D), lottery commission systems 118 will receive a properly formatted lottery ticket purchase record (e.g., a message, etc.) from LSP 104. Lottery commission systems 118 will process and record the corresponding lottery ticket purchase and send LSP 104 a confirmation notice or indication of an actual lottery ticket purchase which recognizes that the same was purchased online via the Internet.

Next, at Step S4-16, LSP 104 will receive the aforementioned purchase confirmation from lottery commission systems 118. LSP 104 will record that confirmation indication in its secure lottery ticket purchase database and, in particular, in the corresponding lottery ticket purchase record.

Next, at Step S4-17, LSP 104 will present a purchase confirmation web page (screen) containing the random, unique secure lottery ticket purchase code to the user via secure communications through the Internet. The user may print the screen received from LSP 104 to evidence his purchase in the event that he has purchased a winning lottery number.

Next, at Step S4-18, lottery commission systems 118 carry out normal operations to select winning lottery numbers (e.g., ping-pong ball selection to derive winning numbers which may be manifested on public television, etc.).

Processing ends at Step S4-19.

Figure 5A:
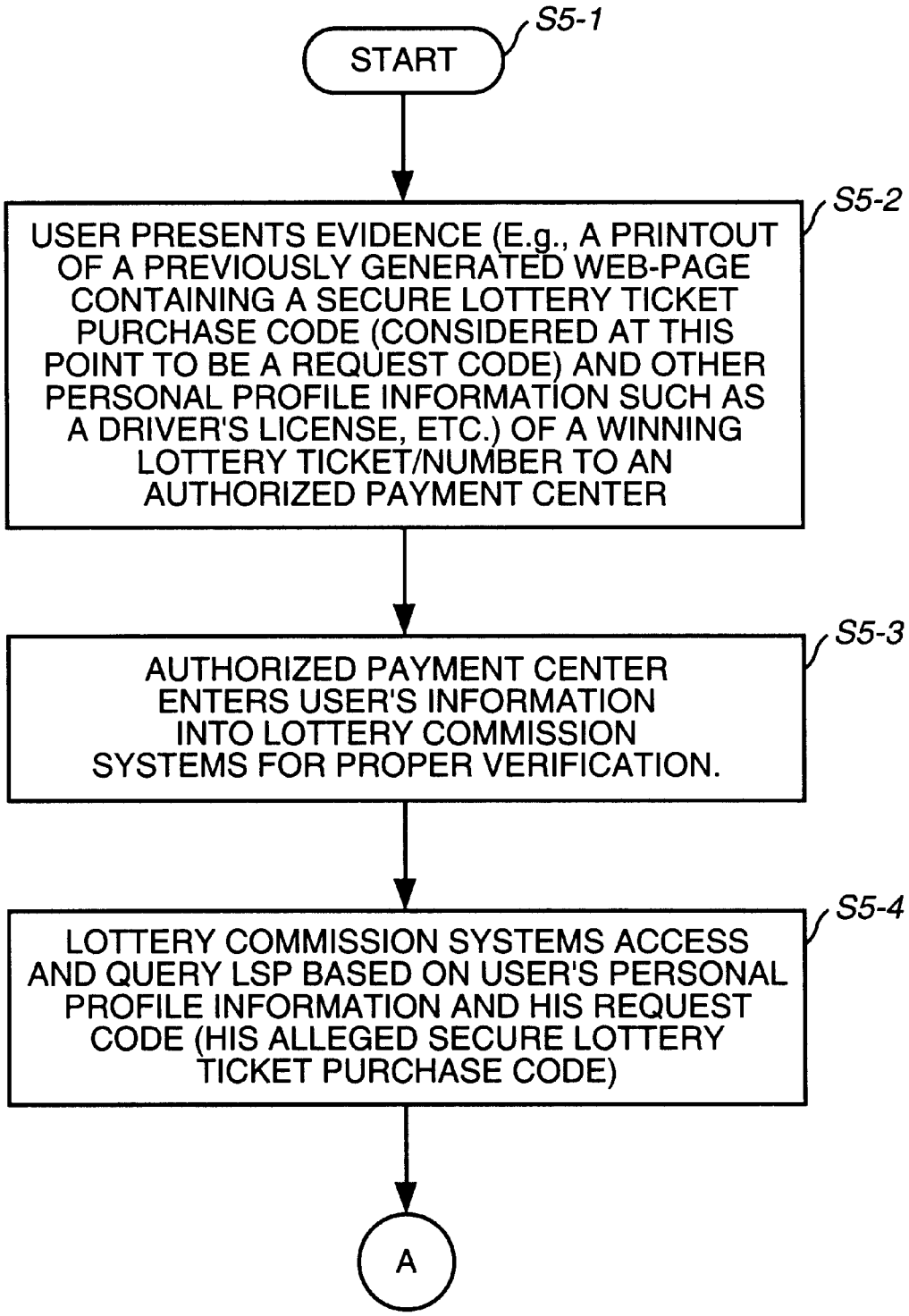
FIG. 5A is flowchart that illustrates a process carried out within the system depicted in FIG. 1 to verify previous lottery ticket purchases made online according to a preferred embodiment of the present invention.
Figure 5B:
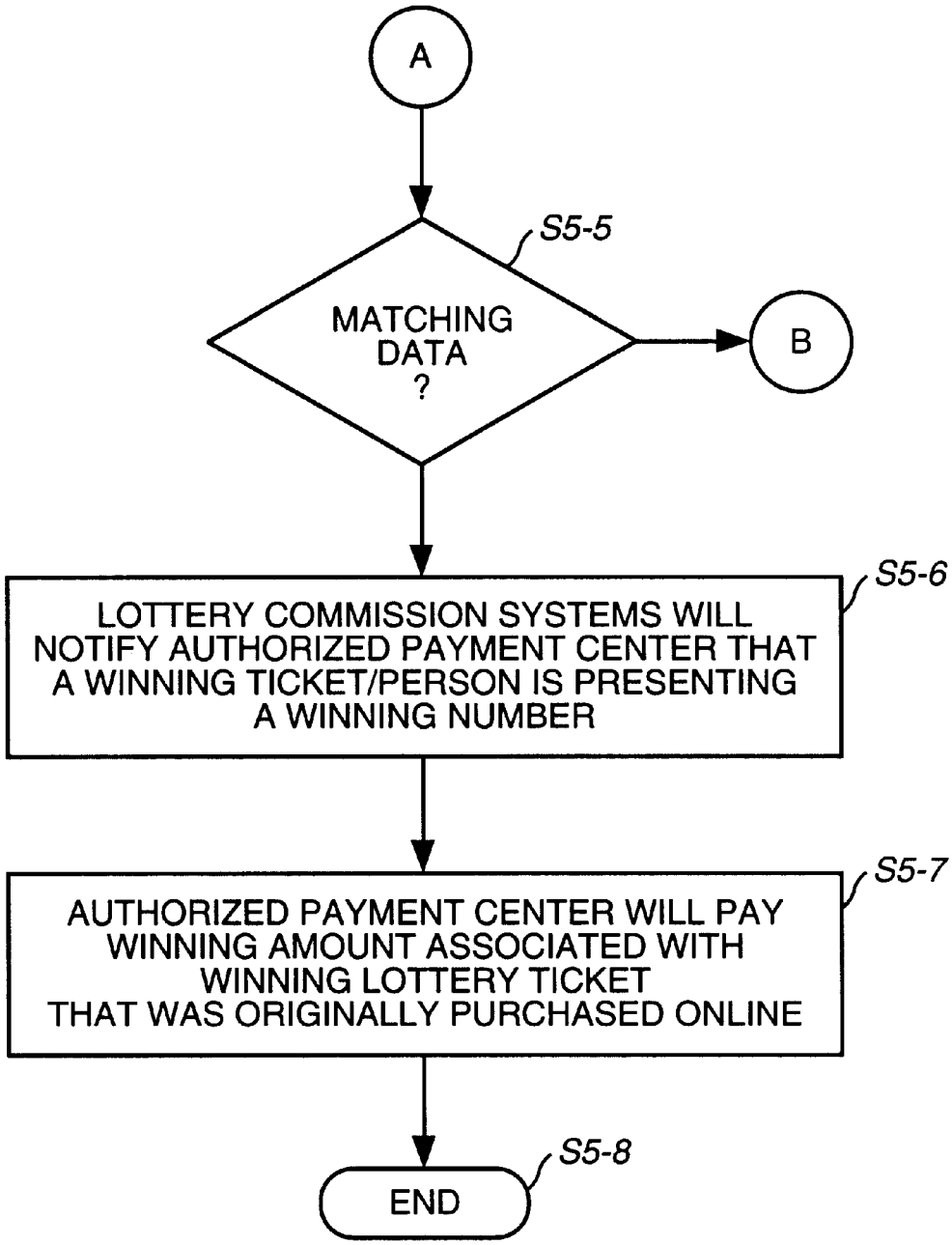
FIG. 5B is a continuation flowchart of the flowchart started in FIG. 5A.
Figure 5C:
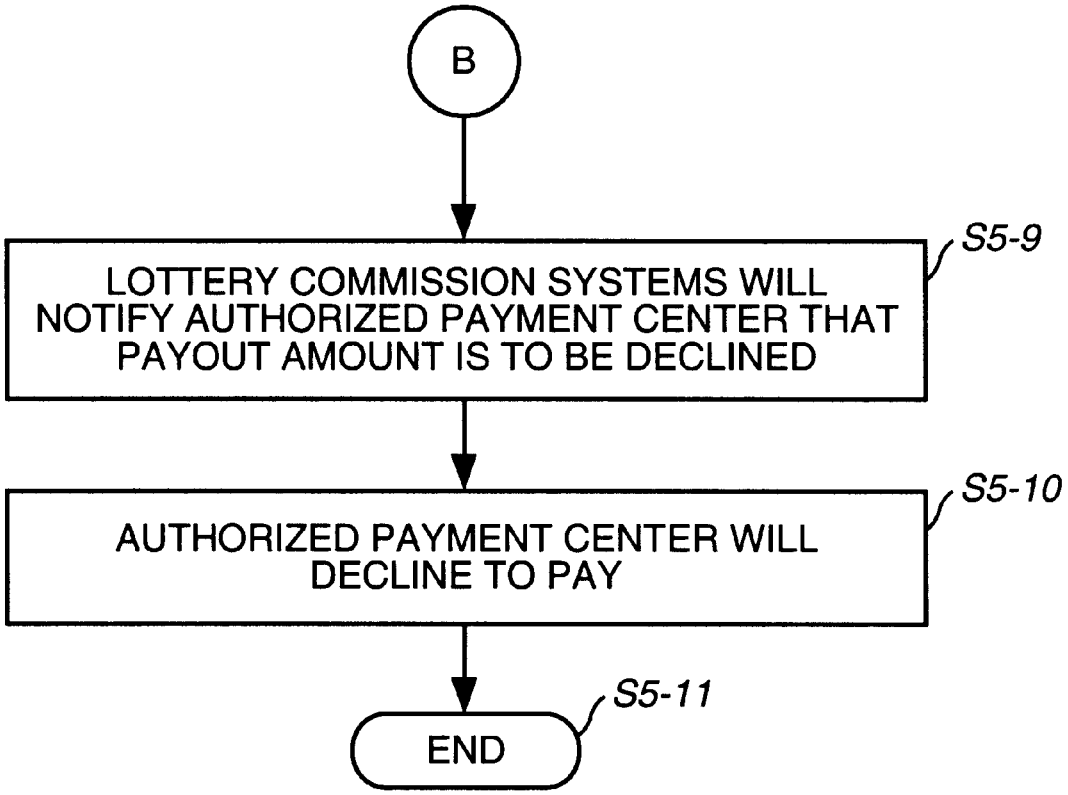
FIG. 5C is a continuation flowchart depicted in FIGS. 5A–5B.

The structures depicted in FIGS. 1–3 also are configured to operate together to facilitate the verification of previously purchased lottery tickets according to the present invention. Such verifications may be carried out by an authorized lottery payoff agent, in conjunction with an LSP, to facilitate the proper payment of monies relative to winning lottery numbers and tickets. The requisite and salient operations to bring about such functionality and services are illustrated in FIGS. 5A–5C. More particularly, the operations depicted in FIGS. 5A–5C, in many respects, are intended to be carried out, as indicated above, via computer software. Such computer software and, in particular, the programming constructs necessary to bring about such operations will be readily apparent to those skilled in the art after reviewing and understanding the operations illustrated in FIGS. 5A–5C.

Referring now to FIG. 5A, depicted therein is flowchart that illustrates a process carried out within the system depicted in FIG. 1 to verify previous lottery ticket purchases made online according to a preferred embodiment of the present invention. Processing starts at Step S5-1 and immediately proceeds to Step S5-2.

At Step S5-2, a user (lottery ticket purchaser) presents evidence of a winning lottery ticket number (e.g., a printout of a previously generated web-site page (screen) containing a randomly generated and unique secure lottery ticket purchase code and some other form of personal identification) to an authorized payment center (payoff agent). The presentation of additional personal information may be necessary within the present invention if the user's screen printout is not to be considered to be a bearer-instrument (or one that is immediately negotiable by the bearer).

Next, at Step S5-3, the authorized payment center will enter the user's information into lottery commission systems 118 for verification of the winning number and the identity of the person who is presenting such information.

Next, at Step S5-4, lottery commission systems 114 will access and query LSP 104 based on the user's personal identification information as presented at the authorized payment center (payoff agent). Processing will thereafter proceed at the top of FIG. 5B.

At Step S5-5 (at the top of FIG. 5B), a determination will be made as to whether a match exists between the user's personal identification information (e.g., his personal profile data and secure lottery ticket purchase code) are consistent with the winning ticket (i.e., that was purchased via the Internet). If not, processing proceeds as illustrated at the top of FIG. 5C. This matching operation involves the determination if a previously stored secure lottery ticket purchase code within LSP 104 is the same as a alleged code (which may be referred to as a "request code") proffered by a person seeking to collect on winning lottery amount. In other words, a person should be able to obtain a payoff amount relative to a winning lottery number when and if the person is able to produce evidence of a previously generated and stored secure lottery ticket purchase code to an authorized payment center.

If a matching record exists (i.e., the user is possessed of a winning lottery ticket purchased on line via the Internet), processing proceeds to Step S5-6. There, lottery commission systems 118 will notify the authorized payment center (payoff agent) that a winning lottery ticket purchaser is presenting a valid winning number and that a payoff of funds may be carried out.

Next, the authorized payment center (payoff agent) will pay a corresponding winning payoff amount to the user. (Stp S5-7)

Processing ends at Step 5-8.

As indicated in regard to Step S5-5, if no match is determined, processing proceeds as illustrated at the top of FIG. 5C. In particular, at Step S5-9, lottery commission systems 118 will notify the authorized payment center that a payoff is to be declined.

Next, at Step S5-10, the authorized payment center will decline the pay the user. Of course, an error in data communications to and from lottery commission systems 118 may have occurred (e.g., user profile information may not have been entered correctly, etc.). In such a case, the entire process depicted in FIGS. 5A–5C may be repeated.

Processing ends at Step S5-11.

Referring now to FIG. 6, depicted therein is a diagram of a database table used for storing information related to lottery tickets purchased online which may be propagated with data and processed in accordance with the steps illustrated in flowcharts depicted in FIGS. 4A–4E and 5A–5C. Database table 600 may be managed by a database management system operated by LSP 104. In particular, database table 600 shows four columns and two rows. Row R1 contains column headings under which data including LOTTERY NUMBERs, USER PROFILE DATA, SECURE LOTTERY TICKET PURCHASE CODEs, and OTHER DATA may be stored. Row R2 contains actual data related to a lottery ticketed which was purchased online via the Internet. In particular, row R2 indicates that a Mr. John Jones purchased a lottery ticket having a lottery number of 376, and which has been associated with a secure lottery ticket purchase code of "013E7XJ29." The other data column for Mr. Jones' lottery ticket may include date of purchase, payoff amount in dollars, place of purchase, lottery name, lottery management system identification (in the case that LSP 104 sells lottery tickets for lotteries maintained by one or more jurisdictions, for example) date of lottery drawing, and/or any other data that may be needed to effectively operate a lottery in which lottery tickets may be purchased online and, possibly, via the Internet. Such other data may change depending on the needs of a particular lottery and the requirements of a particular lottery commission or authority, etc.

Thus, having fully described the present invention by way of example with reference to the attached drawing figures, it will be readily appreciated that many changes and modifications may be made to the invention and to any of the exemplary embodiments shown and/or described herein without departing from the spirit or scope of the invention which is defined in the appended claims.

What is claimed is:

1. A system for facilitating the purchase and sale of a lottery ticket online, comprising:

a data storage system for storing information related to a lottery ticket purchased online and to a purchaser of said lottery ticket, said lottery ticket including a lottery game value, and a data processing system coupled to said data storage system and operative to receive an online request from said purchaser to purchase said lottery ticket, to generate a secure lottery ticket purchase code in response to the request, and to issue an electronic purchase confirmation notice related to said lottery ticket to said purchaser, said purchase confirmation notice including said secure lottery ticket purchase code, said data processing system further operative to store said lottery ticket purchase code in said data storage system; wherein the information related to the purchaser of the lottery ticket includes personal information of the purchaser, the personal information including at least one of a name, address, and telephone number of the purchaser, the personal information being used by the system to verify a winning lottery ticket by matching the stored information relating to the lottery ticket to the personal information of the purchaser attempting to redeem the winning lottery ticket.

2. The system according to claim 1, wherein said data processing system is further operative to communicate said information and said secure lottery ticket purchase code to a lottery commission system operated by a lottery commission.

3. The system according to claim 2, wherein said data processing system is further operative to receive a confirmation message from said lottery commission system that said lottery ticket has been sold by said lottery commission to said purchaser, and to store said confirmation message from said lottery commission system in said data storage system.

4. The system according to claim 1, wherein said request is received by said data processing system via the Internet.

5. The system according to claim 1, wherein said secure lottery ticket purchase code is a unique, randomly generated string of digits.

6. The system according to claim 1, wherein said purchase confirmation notice is issued to said purchaser via the Internet.

7. The system according to claim 1, wherein said information and said lottery ticket purchase code are stored in a secure, encrypted table within said data storage system.

8. The system according to claim 1, wherein said data processing system is further operative to generate a random number, said lottery game value being set based on said random number.

9. A method for facilitating the purchase and sale of a lottery ticket online, comprising the steps of:

receiving an online request from a purchaser to purchase a lottery ticket in the context of a lottery operated by a lottery authority, said request including information related to said purchaser and to a lottery game value to be associated with said lottery ticket;

generating a secure lottery ticket purchase code in response to the online request;

issuing an electronic purchase confirmation notice related to said lottery ticket to said purchaser, said purchase confirmation notice including said secure lottery ticket purchase code;

and retrievably storing said information, said lottery game value, and said secure lottery ticket purchase code in a data storage system to be accessed by said lottery authority in operating said lottery; wherein the information related to the purchaser of the lottery ticket includes personal information of the purchaser, the personal information including at least one of a name, address, and telephone number of the purchaser, the personal information being used to verify a winning lottery ticket by matching the stored information to the personal information of the purchaser attempting to redeem the winning lottery ticket.

10. The method according to claim 9, further comprising a step of:

communicating said information and said secure lottery ticket purchase code to a lottery commission system operated by said lottery authority.

11. The method according to claim 9, further comprising the steps of:

receiving a confirmation message from said lottery commission system that said lottery ticket has been sold by said lottery authority to said purchaser; and retrievably storing said confirmation message from said lottery commission system in said data storage system.

12. The method according to claim 9, wherein said online request is received via the Internet.

13. The method according to claim 9, wherein said secure lottery ticket purchase code is a unique, randomly generated string of digits.

14. The method according to claim 9, wherein said purchase confirmation notice is issued to said purchaser via the Internet.

15. The method according to claim 9, wherein said information and said lottery ticket purchase code are stored during said retrievably storing step in a secure, encrypted database table.

16. The method according to claim 9, further comprising the steps of:

generating a random number; and setting said lottery game value based on said random number.

17. A system for facilitating a lottery payoff based on a lottery ticket purchased online, comprising:

a lottery ticket issuance system storing information related to a lottery ticket purchased online, a secure lottery ticket purchase code, and personal information of a purchaser of said lottery ticket, said lottery ticket having an associated lottery game payoff amount; and a lottery management system operated by a lottery authority and coupled to said lottery ticket issuance system, said lottery management system operative to receive a request from said purchaser to receive said payoff amount associated with said lottery ticket, said request including a request code and personal information, said management system further operative to access and query said lottery ticket issuance system to determine if said request code matches said secure lottery ticket purchase code and said personal information matches the personal information of the purchaser that is stored in the lottery ticket issuance system, to receive a match status message from said lottery ticket issuance system, said match status message indicating whether said request code matches said secure lottery ticket purchase code and the personal information matches the personal information stored in the lottery ticket issuance system, said lottery management system further operative to notify said lottery authority that said payoff amount may be paid to said purchaser when said match status message indicates a match.

18. The system according to claim 17, wherein said secure lottery ticket purchase code is a random, unique string of digits.

19. The system according to claim 17, wherein said lottery ticket issuance system and said lottery management system are coupled via the Internet.

20. The system according to claim 17, wherein said lottery ticket issuance system stores said secure lottery ticket purchase code in a secure database table.

21. The system of claim 17, wherein the personal information of the purchaser includes at least one of a name, address, and telephone number of the purchaser.

22. A method for facilitating a lottery payoff based on a lottery ticket purchased online, comprising the steps of:

receiving a request from a purchaser to receive a payoff amount associated with a lottery ticket purchased online, said request including a request code and personal information;

accessing and querying a lottery ticket issuance system to determine if said request code matches a previously stored secure lottery ticket purchase code and if said personal information matches previously stored personal information relating to the purchaser;

receiving a match status message from said lottery ticket issuance system, said match status message indicating whether said request code matches said previously stored secure lottery ticket purchase code and whether the personal information matches the previously stored personal information; and notifying a lottery authority that said payoff amount may be paid to said purchaser when said request code matches said secure lottery ticket purchase code and said personal information matches the previously stored personal information.

23. The method according to claim 22, wherein said previously stored secure lottery ticket purchase code is a random, unique string of digits.

24. The method according to claim 22, wherein said lottery ticket issuance system is accessed via the Internet.

25. The method according to claim 22, wherein said previously stored lottery ticket purchase code is stored in a secure database table.

26. The method of claim 22, wherein the personal information related to the purchaser includes at least one of a name, address, and telephone number of the purchaser.

* * * * *